US006521103B2

(12) United States Patent
Harris et al.

(10) Patent No.: US 6,521,103 B2
(45) Date of Patent: Feb. 18, 2003

(54) PLATING CLAMP ASSEMBLY

(75) Inventors: John Scott Harris, Valrico, FL (US); Kam Sourivongs, Tampa, FL (US); Dale Jackson, Clearwater, FL (US)

(73) Assignee: Surface Finishing Technologies, Inc., Clearwater, FL (US)

( * ) Notice: Subject to any disclaimer, the term of this patent is extended or adjusted under 35 U.S.C. 154(b) by 57 days.

(21) Appl. No.: 09/874,761

(22) Filed: Jun. 5, 2001

(65) Prior Publication Data

US 2002/0179438 A1 Dec. 5, 2002

(51) Int. Cl.[7] ..... C25B 9/00

(52) U.S. Cl. ..... 204/297.07; 204/297.01; 204/297.06; 204/297.08; 204/297.09; 204/297.1; 204/297.14; 204/198; 204/286.1; 204/287; 204/288.3

(58) Field of Search ..... 204/198, 286.1, 204/287, 288.3, 297.01, 297.06, 297.07, 297.08, 297.09, 297.1, 297.14

(56) References Cited

U.S. PATENT DOCUMENTS

| | | | | | |
|---|---|---|---|---|---|
| 4,085,997 | A | * | 4/1978 | Hainsworth | 204/297.09 |
| 4,326,937 | A | * | 4/1982 | Neumeier et al. | 204/198 |
| 5,380,418 | A | * | 1/1995 | Strecker | 204/297.09 |
| 5,901,997 | A | * | 5/1999 | Bayer | 204/297.09 |
| 6,193,863 | B1 | * | 2/2001 | Kobayashi | 204/297.09 |
| 6,267,856 | B1 | * | 7/2001 | Brown | 204/297.09 |
| 6,325,903 | B1 | * | 12/2001 | Brown | 204/297.09 |
| 6,342,138 | B1 | * | 1/2002 | Brown | 204/297.09 |

* cited by examiner

*Primary Examiner*—Bruce F. Bell
(74) *Attorney, Agent, or Firm*—Arthur W. Fisher III

(57) ABSTRACT

A plating clamp assembly for use with a plating system including a plating bath and an article transport assembly to selectively engage an article to be plated as the article is moved through the plating bath by the article transport assembly to coat at least a selected portion of the surface of the article with material without creating faults on the selected portion of the surface of the article.

36 Claims, 9 Drawing Sheets

PLATING CLAMP ASSEMBLY

BACKGROUND OF THE INVENTION

1. Field of the Invention

A plating clamp assembly to engage an article as the article is coated with a material.

2. Description of the Prior Art

Articles are sometimes coated with material for electrical conductivity, to create a particular aesthetic appearance or to provide a protective finish to prevent tarnishing and other deleterious effects from the surrounding environs. Articles that are so coated or plated often bear defects or faults in the surface finish resulting from the point or points of contact of the article support means used in the plating process. Thus, there is a need for a system or apparatus capable of plating or coating an article without surface faults.

An example of the efforts to design such an apparatus or system is found in U.S. Pat. No. 2,992,134 that relates to a method and apparatus for coating articles. The apparatus comprises an open framework or receptacle for supporting a tank containing a bath of a coating solution together with an upper article support means and a lower article support means to support an article such as a spoon during a dip coating process. Each article support means comprises a pair of corresponding Z-shaped members to selectively engage and support the article during the plating process. An actuating member including camming surfaces selectively opens the lower article support means and the upper article support means. Specifically, the upper article engaging members are normally closed under the tension of a spring; while the lower article engaging members are normally biased open under the tension of a spring.

After the upper article support rack assembly has been placed on the mounting mechanism a piston is operated to lower the mounting mechanism and the upper article support assembly together toward the lower article support rack assembly as the lower portion of the article is lowered into the bath. It will be noted that the normal supported position of the lower article support assembly under the biasing action of the spring is such that follower members are in contact with the top of lower cam surfaces. Movement of the mounting mechanism downwardly will cause the lower article support assembly to be lowered further into the bath against the upward force of the compression spring both the upper article support assembly and the lower article support assembly moving downwardly together in unison. This continued movement will cause the lower article engaging members to commence to close as follower members pivot as rollers abut against cam surfaces causing the plates to move to the closing positions. The upper cam surfaces will contact with follower members for the upper article engaging members so that upon further downward movement of the mounting mechanism the upper article engaging members will move into an open position by the action of follower members against upper cam surfaces. Thus transfer of articles from the upper support assembly to the lower support assembly is accomplished. Further downward movement of both upper and lower article support assemblies will cause actuating member at the top of the cam surfaces to abut up against the underside of plate members preventing further downward movement of upper article support rack assembly. It will be noted that the lower article engaging members have completely closed and that upper article engaging members have completely opened thereby completing the transfer of articles from the upper article support assembly to the lower article support assembly. After the article has been submerged in the coating bath, movement of the piston is reversed and the lower article support rack assembly is raised under the biasing action of springs. Further upward movement causes the upper article support rack assembly to move together again in unison with the lower article support rack assembly. Further upward movement will cause the upper follower members and the lower follower members to engage their respective cam surfaces causing the upper engaging members and the lower engaging members to be actuated, the upper engaging members closing and the lower engaging members opening.

Unfortunately, the apparatus and method of U.S. Pat. No. 2,992,134 is extremely slow due to the reciprocal operation of the article support means with a low throughput and resultant relative high cost per article. A need remains for an effective, efficient, high speed, low cost plating assembly.

SUMMARY OF THE INVENTION

The present invention relates to a plating clamp assembly for use with a plating system including a plating bath and an article transport assembly to selectively engage an article to be plated moved through the plating bath by the transport assembly to coat at least a selected portion of the surface of the article with material without creating faults on the selected portion of the surface of the article.

More specifically, the plating clamp assembly comprises a first clamp assembly and a second clamp assembly to selectively position the plating clamp assembly in a plurality of clamping configurations to load and unload an article into and from the plating clamp assembly and to selectively engage and disengage the article traveling through the plating bath during the plating process.

The first clamp assembly comprises a first clip assembly movable between a first or engagement position and a second or disengagement position and a first clip assembly positioning mechanism to selectively move the first clip assembly between the first or engagement position and the second or disengagement position as described hereinafter. The second clamp assembly comprises a second clip assembly movable between a first or engagement position and a second or disengagement position and a second clip assembly positioning mechanism to selectively move the second clip assembly between the first or engagement position and the second or disengagement position as described hereinafter. The first and second clamp assemblies operate independently of each other.

The first clip assembly and the second clip assembly each comprises a first article engaging prong and a second article engaging prong configured to operate in unison. The first clip assembly positioning mechanism and the second clip assembly positioning mechanism each comprises a chip positioning mechanism and a prong positioning mechanism to selectively move the first article engaging prong and the second article engaging prong of the corresponding first clip assembly and the second clip assembly between the first or article engagement position to a second or article disengagement position.

In operation, an article to be plated is grasped by the first clip assembly and the second clip assembly as the plating clamp assembly moves through the plating bath or processing chamber with the first clip assembly positioning mechanism and the second clip assembly positioning mechanism in the first or article engagement positions. As the plating clamp assembly travels or moves through the processing chamber, the first clip assembly positioning mechanism and the second clip assembly positioning mechanism sequentially and alternately move the corresponding clip positioning mechanism and prong positioning mechanism between the first and second positions to move the corresponding first and second article engaging prongs between the first or article engagement position and the second or article disengagement position to coat portions of the surface of the article with material without creating faults on the selected portion of the surface of the article.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
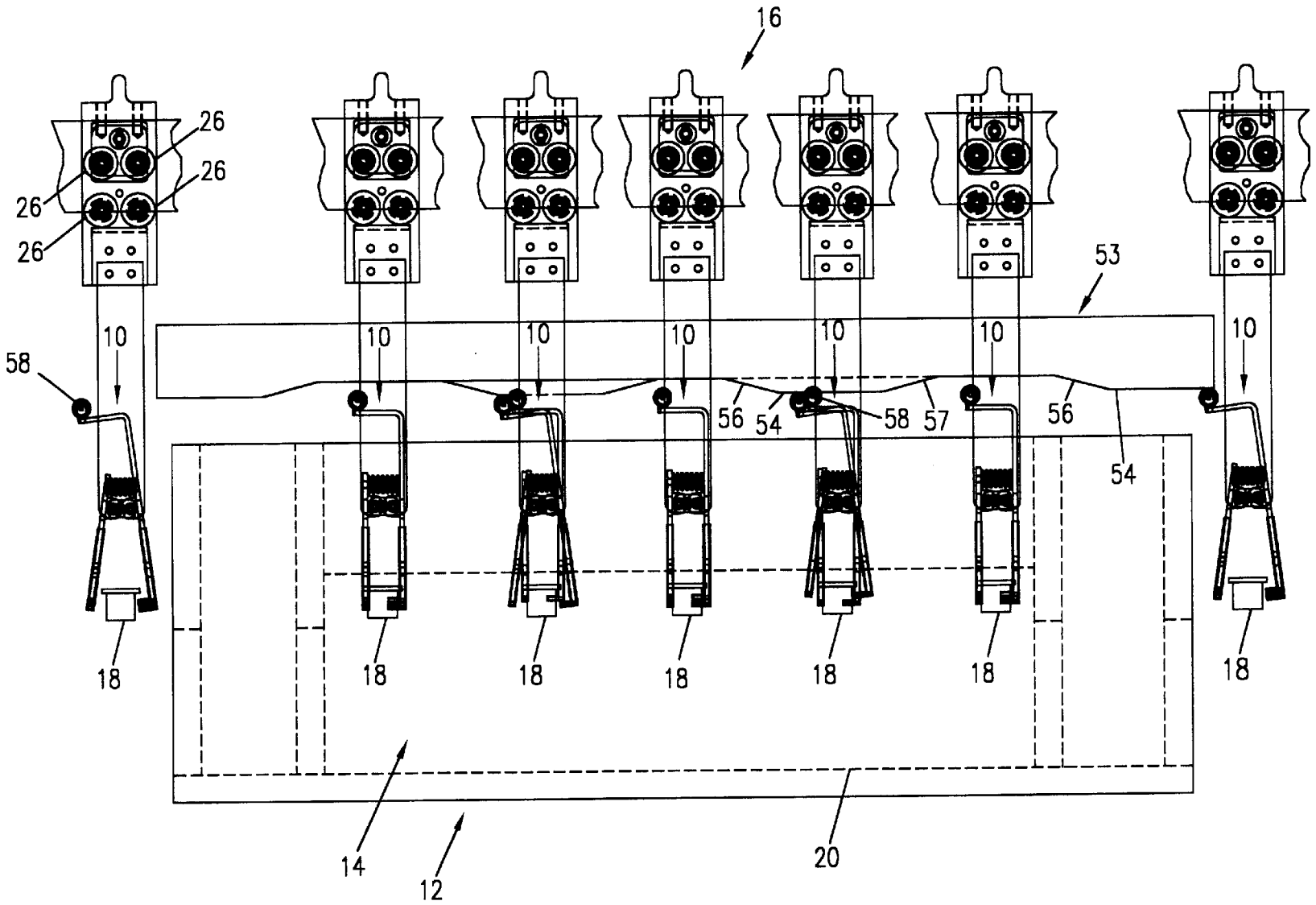
FIG. 1 is a diagrammatic side view of the plating clamp assembly of the present invention in the various plurality of clamping configurations and plating apparatus/system.

FIG. 1 shows a plurality of plating clamp assemblies each generally indicated as 10 for use with a plating system including a plating bath or cell generally indicated as 12 to retain a plating liquid or material 14 therein and an article transport assembly generally indicated as 16 to selectively engage articles 18 to be plated as the articles 18 are moved through the plating bath or cell 12 by the article transport assembly 16.

For example, the plating clamp assembly 10 can be used with an electroplating system to mechanically capture and transport the article 18 to be electroplated and to electrically connect DC power to the article making the article receptive to the exchange of metal ions. Such an electroplating system includes a series of cleaning, plating, rinsing and drying process cells and an article transport assembly to selectively engage an article 18 to be electroplated as the article 18 is moved through the various process steps, ensuring that all the areas of the article 18 are completely and uniformly cleaned, plated, rinsed, and dried leaving no unplated areas, marks, dents, water spots or other imperfections at the connection point between the article 18 and the clamping assemblies described hereafter or elsewhere on the article 18.

Figure 2:
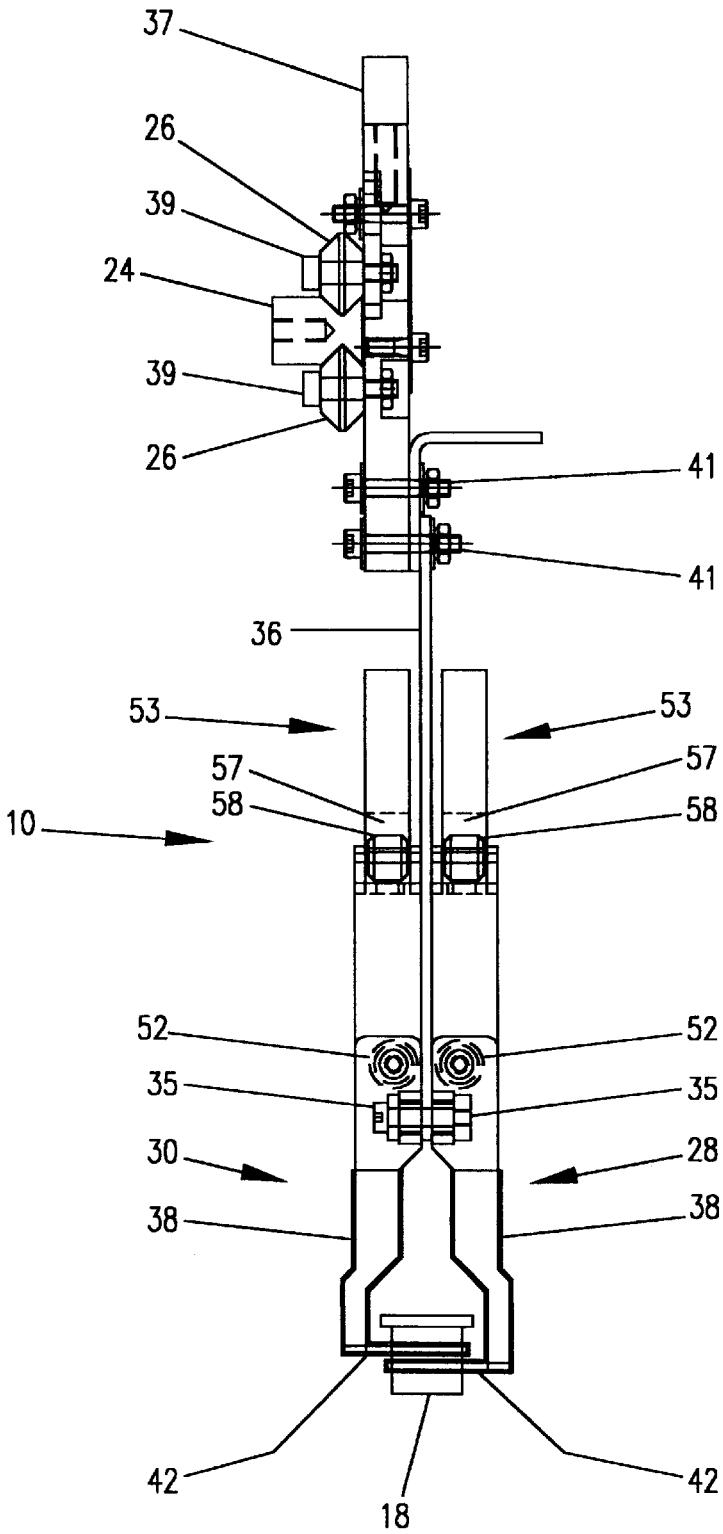
FIG. 2 is a detailed front view of the plating clamp assembly of the present invention and partial transport assembly.
Figure 3:
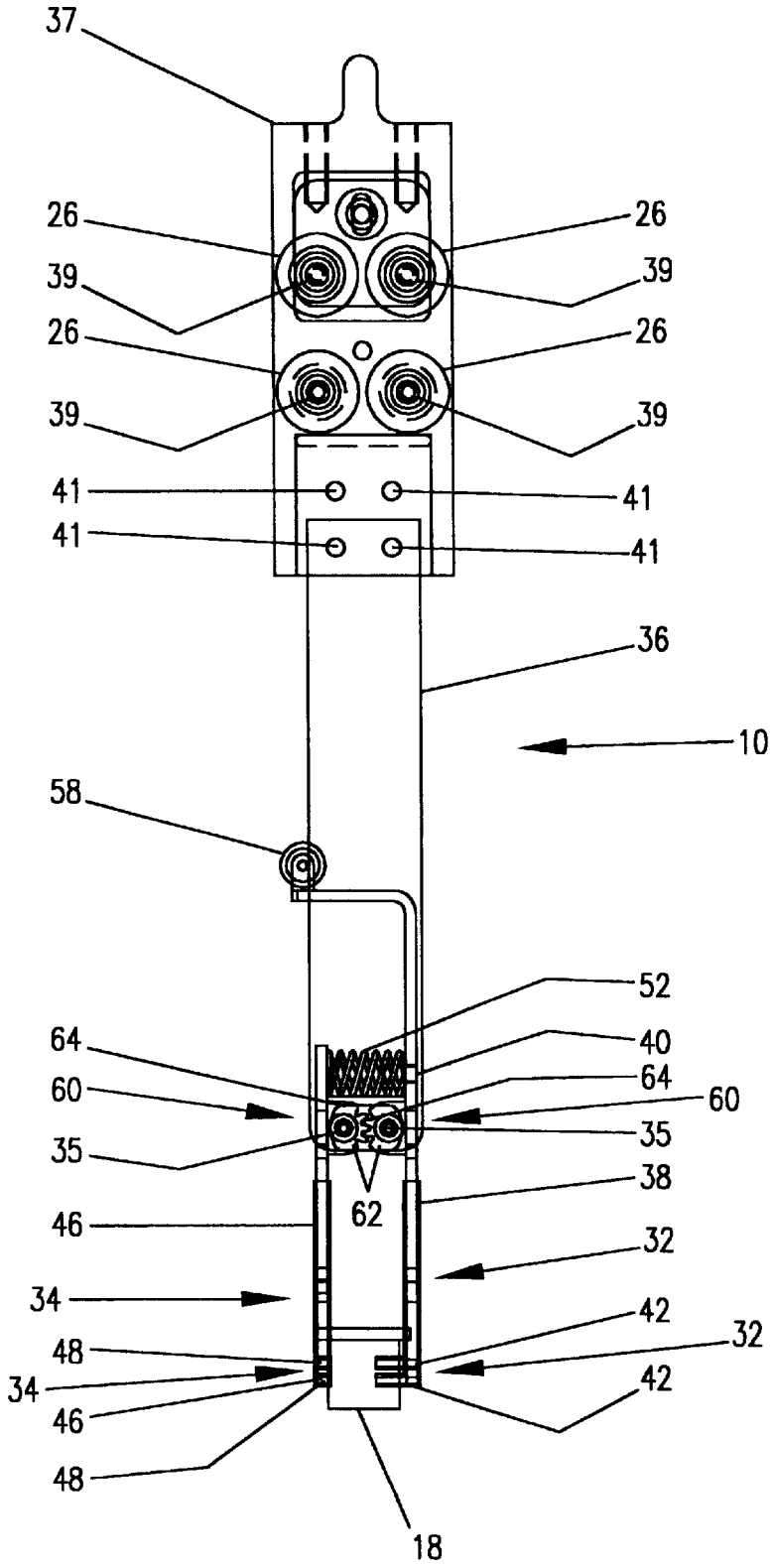
FIG. 3 is a detailed side view of the plating clamp assembly of the present invention.

As shown in FIG. 1, the plating bath or cell 12 comprises a plating cell or other reservoir 20 suitable for use with any state of the art plating process or system. As shown in FIGS. 1 through 3, the article transport system 16 may comprise a bandolier transport (not shown in detail) with a guide rail 24 to support a plurality guide members or rollers each indicated as 26 or other similar coupling or mounting members. Of course, any other state of the art transport system capable of transporting or moving at least one plating clamp assembly 10 and article 18 through the liquid container or reservoir 20 may be employed.

As best shown in FIG. 2, each plating clamp assembly 10 comprises a first clamp assembly and a second clamp assembly generally indicated as 28 and 30 respectively.

Figure 4:
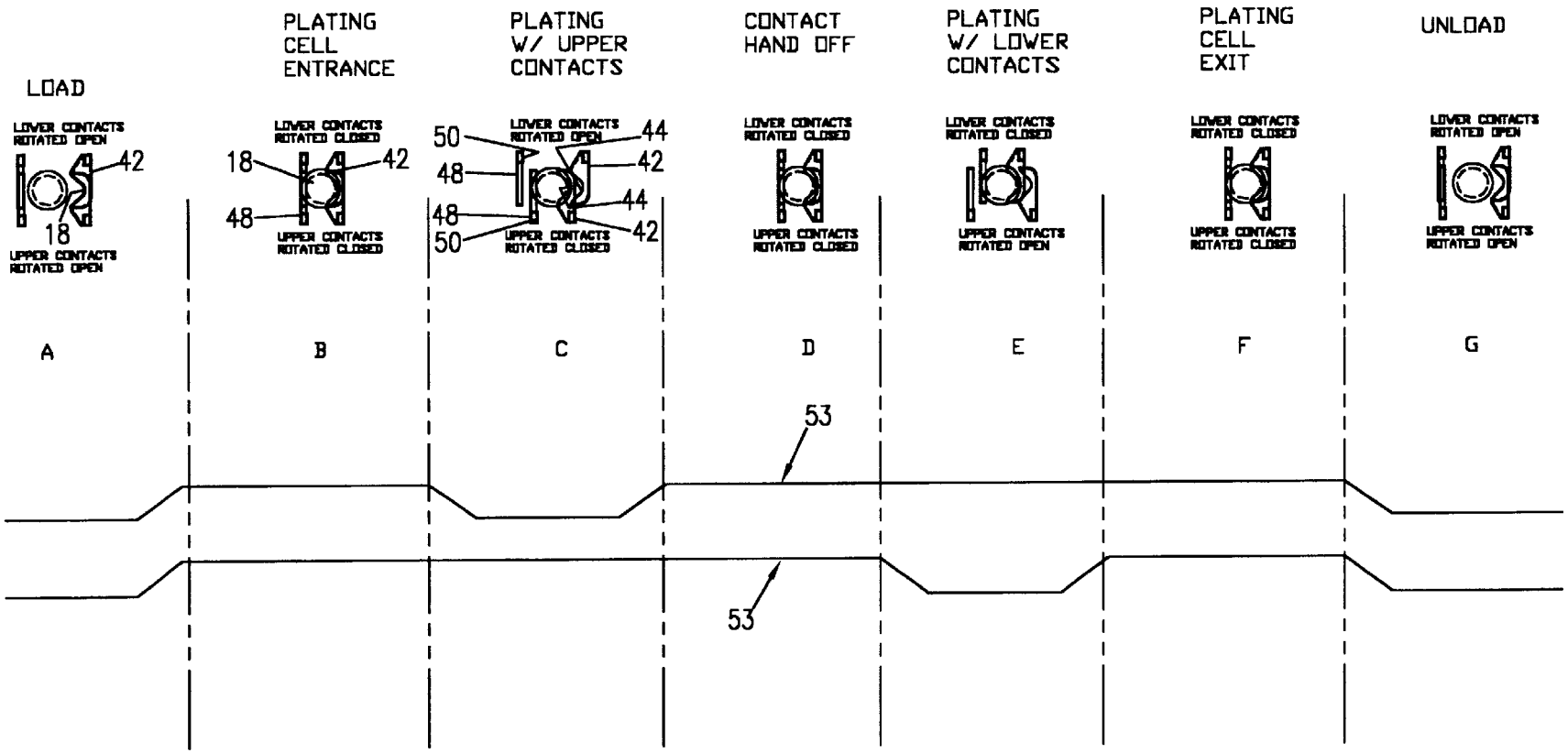
FIG. 4 is a detailed partial top view of the clip assembly of the present invention in the various plurality of clamping configurations corresponding to the clamping configurations A through G and corresponding actuator members depicted in FIG. 1.

As shown in FIG. 1, each first clamp assembly 28 comprises a first clip assembly moveable between a first or article engagement position and a second or article disengagement position and a first clip assembly positioning mechanism to selectively position the corresponding plating clamp assembly 10 in the plurality of clamping configurations A through G as shown in FIG. 4 to load and unload an article 18 into and from the corresponding plating clamp assembly 10 and to selectively engage and disengage the article 18 traveling through the plating bath or cell 12 during the plating process.

Similarly, as shown in FIG. 1, each second clamp assembly 30 comprises a second clip assembly moveable between a first or article engagement position and a second or article disengagement position and a second clip assembly positioning mechanism to selectively position the corresponding plating clamp assembly 10 in the plurality of clamping configurations A through G as shown in FIG. 4 to load and unload an article 18 into and from the corresponding plating clamp assembly 10 and to selectively engage and disengage the article 18 traveling through the plating bath or cell 12 during the plating process.

As shown in FIGS. 2 and 3, the first clip assembly 28 and the second clip assembly 30 each comprises a first or front article engaging prong generally indicated as 32 and a second or rear article engaging prong generally indicated as 34 pivotally mounted by a corresponding connector or pin 35 to a substantially vertical clamp assembly hanger or coupling member 36 coupled to the transport assembly 16 by the guide members or rollers 26 rotatably mounted to a header member 37 by a corresponding connector(s) or pin(s) 39. The substantially vertical clamp assembly hanger or coupling member 36 is affixed to the header member 37 by a plurality of fasteners each indicated as 41.

As shown in FIGS. 2 and 3, each first article engaging prong 32 comprises a prong member 38 including a retainer member or post 40 formed or affixed to the upper end portion thereof and an article engaging member 42 having an article engaging surface 44 (FIG. 4) to engage an article 18 when the corresponding clamp assembly 28/30 is in the first or article engagement position. Each second article engaging prong 34 comprises a prong member 46 including an article engaging member 48 having an article engaging surface 50 (FIG. 4) to engage an article 18 when the corresponding clamp assembly 28/30 is in the first or article engagement position. As best shown in FIG. 3, the first article engaging members 42 and 48 of the first clamp assembly 28 are disposed in spaced relation above the first article engaging members 42 and 48 of the second clamp assembly 30.

The article engaging surface 44 comprises a recess; while the article engaging surface 50 may comprise a substantially flat surface or recess.

As best shown in FIG. 4, the recesses may be concave, V-shaped or similarly configured article engaging surface 44 of the first clip assembly 28 is offset in the recess of horizontal plane relative to the recess of article engaging surface 44 of the second clip assembly 30 to cooperatively form an article alignment means to center the articles 18 in the plating assembly 10.

The first clamp assembly 28 and the second clamp assembly 30 is configured such that prong members 38 and 46 are located away from the area between cathode and anode bars, cleaning and rinsing nozzles and drying nozzles so as not to block or otherwise mechanically interfere with the delivery of fresh metal plating ions to surface of article or the delivery of cleaning or rinsing solution to the article, the ability to completely dry the article 18. Furthermore, each clamp assembly 28 and 30 are configured so that the articles engaging prongs 32 and 34 simultaneously disengaged in a scissor-like motion such as not to block or otherwise mechanically interfere with the delivery of fresh metal plating ions to surface of article, the delivery of cleaning or rinsing solution to the article, and the ability to completely dry the article 18. The configuration and operation as described hereinafter provides relatively simple automatic loading and unloading of the articles 18.

As described more fully hereinafter, the first clip assembly positioning mechanism and the second clip assembly positioning mechanism each comprises a clip positioning mechanism and a prong positioning mechanism to selectively move the first article engaging prong 32 and the second article engaging prong 34 of the corresponding first clip assembly 28 and a second clip assembly 30 between the first or article engagement position to the second or article disengagement position.

As shown in FIGS. 1 through 3, each prong positioning mechanism comprises a spring or bias 52 disposed to engage the inner surface of the upper portions of the prong member 38 of the first article engaging prong 32 and the corresponding prong member 46 of the second article engaging prong 34 to normally maintain the corresponding clamp assembly 28 and 30 in the first or article engagement position. Each spring or bias 52 is retained in operative position by a corresponding retainer member 40.

As shown in FIGS. 1 through 3, each clip positioning mechanism comprises a first clip positioning actuator to selectively move the corresponding first article engaging prong 32 from the first or article engagement position to the second or article disengagement position to disengage the article 18 and a second clip positioning actuator to selectively move the corresponding second article engaging prong 34 from the first or article engagement position to the second or article disengagement position to disengage the article 18 when the corresponding first article engaging prong 32 moves from the first or article engagement position.

The first clip positioning actuator comprises a substantially vertically disposed actuator member generally indicated as 53 having a plurality of substantially horizontal cam members or surfaces each indicated as 54 having a first transition section or surface 56 and a second transition section or surface 57 disposed adjacent opposite ends thereof and a cam follower or roller 58 rotatably attached to the upper end portion of the corresponding prong member 38 of the first article engaging prong 32.

The actuator members 53 of the first clip assembly 28 and the second clip assembly 30 are disposed above the plating clamp assembly 10 in substantially parallel relationship relative to each other such that the corresponding cam members or surfaces 54 engages the corresponding cam follower or roller 58 of the first clip positioning actuator 54 as the plating clamp assembly 10 moves or travels through the plating liquid/material 14 to selectively move the first article engaging prong 32 from first or engagement position to second or disengagement position.

In addition, as shown in FIGS. 1 and 4, portions of the cam members or surfaces 54 of the first clip positioning actuators are aligned while loading and unloading the article 18 into and from the plating clamp assembly 10 to simultaneously open and close the first clip assembly 28 and the second clip assembly 30.

Each second clip positioning actuator generally indicated as 60 comprises a plurality of teeth generally indicated as 62 formed on a corresponding clip actuator member 64 formed on the prong member 46 of second article engaging prong 34 by the pivot or pin 35 and the prong member 38 of first article engaging prong 32 to the pivot or pin 35. The corresponding plurality of teeth 62 of the first or front article engaging prong 32 and second or rear article engaging prong 34 mesh or engage such that movement of the prong member 38 of the first or front article engaging prong 32 from the first or article engagement position to the second or article disengagement position causes the prong member 46 of the second or rear article engaging prong 34 from the first or article disengagement position to the second or article disengagement position such that the article engaging surface 44 of first article engaging member 42 of first article engaging prong 32 disengages the article 18 at the same time the article engaging surface 50 of article engaging member 48 of second article engaging prong 34 disengage the opposite side of the article 18.

The spring or bias 52 of each prong positioning mechanism will move corresponding plating clamp assembly 10 from second disengagement position to first or engagement position when the corresponding cam member or surface 54 and the corresponding cam follower or roller 58 are not engaged.

Figure 5:
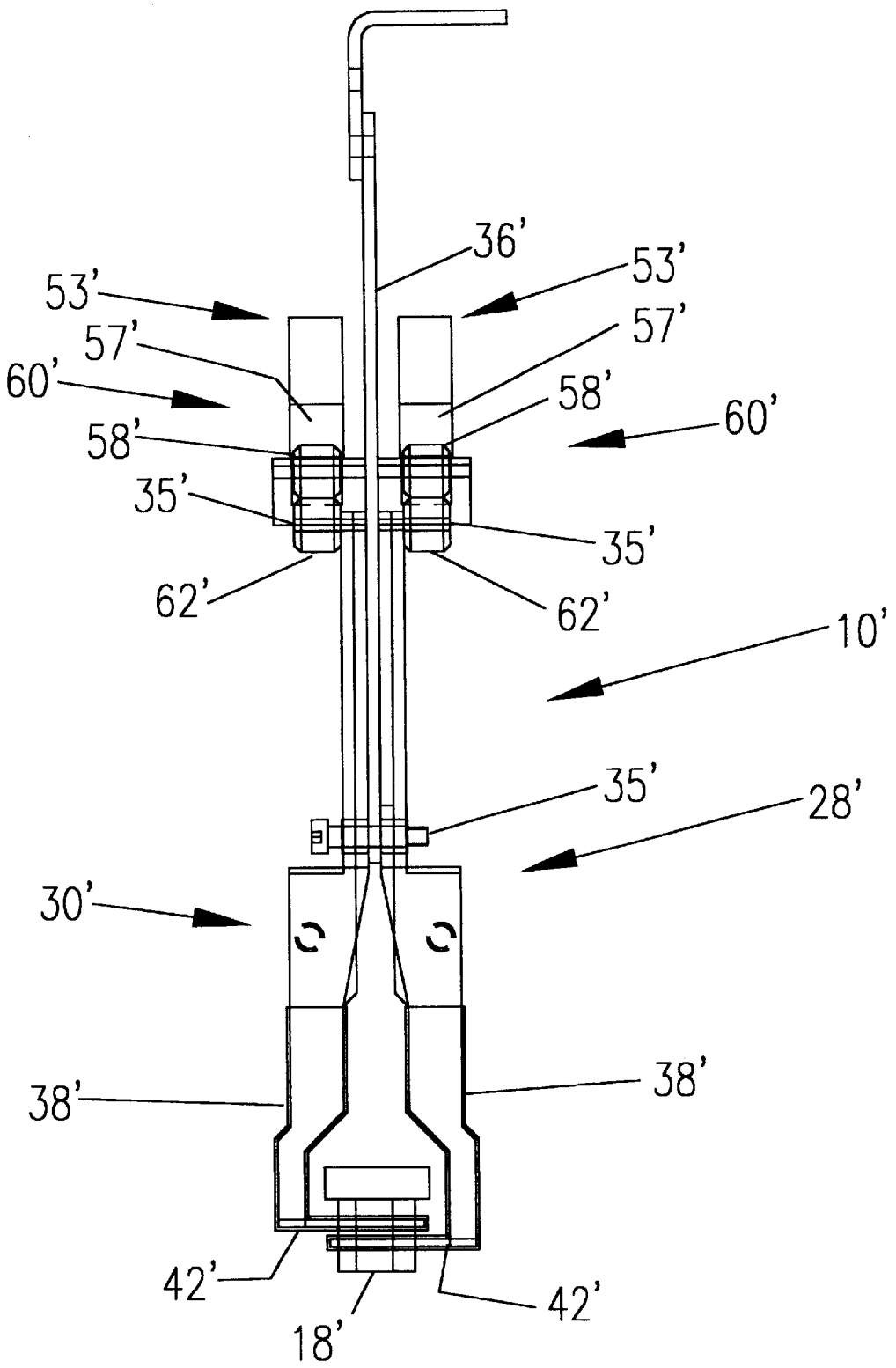
FIG. 5 is a detailed front view of an alternate embodiment of the plating clamp assembly of the present invention.
Figure 6:
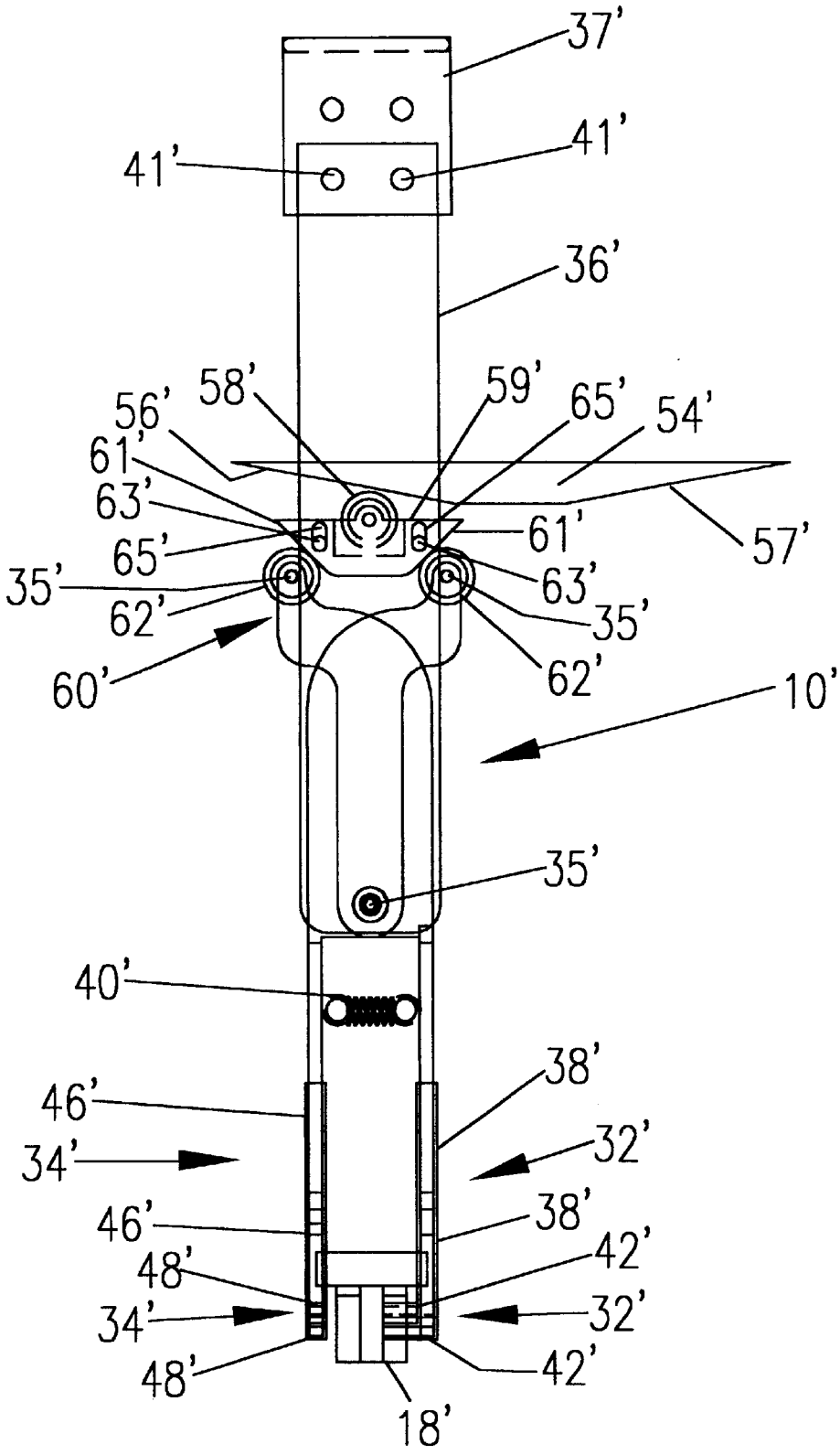
FIG. 6 is a detailed side view of the alternate embodiment of the plating clamp assembly of the present invention shown in FIG. 5.

FIGS. 5 and 6 show an alternate embodiment of a plate clamping assembly 10' comprising a first clamp assembly and a second clamp assembly generally indicated as 28' and 30' respectively.

As shown in FIG. 5, each first clamp assembly 28' comprises a first clip assembly moveable between a first or engagement position and a second or disengagement position and a first clip assembly positioning mechanism to selectively position the corresponding plating clamp assembly 10' in the plurality of clamping configurations A through G as shown in FIG. 4 to load and unload an article 18 into and from the corresponding plating clamp assembly 10' and to selectively engage and disengage the article 18 traveling through the plating bath or cell 12 during the plating process.

Similarly, as shown in FIG. 5, each second clamp assembly 30' comprises a second clip assembly moveable between a first or engagement position and a second or disengagement position and a second clip assembly positioning mechanism to selectively position the corresponding plating clamp assembly 10' in the plurality of clamping configurations A through G as shown in FIG. 4 to load and unload an article 18 into and from the corresponding plating clamp assembly 10' and to selectively engage and disengage the article 18 traveling through the plating bath or cell 12 during the plating process.

As shown in FIGS. 5 and 6, the first clip assembly 28' and the second clip assembly 30' each comprises a first or front article engaging prong generally indicated as 32' and a second or rear article engaging prong generally indicated as 34' pivotally mounted by a corresponding connector or pin 35' to a substantially vertical clamp assembly hanger or coupling member 36' coupled to the transport assembly 16 by a header member 37'. The substantially vertical clamp assembly hanger or coupling member 36' is affixed to the header member 37' by a plurality of fasteners each indicated as 41'.

As in FIGS. 5 and 6, each first article engaging prong 32' comprises a prong member 38' including a retainer member 40' formed or affixed to the upper end portion thereof and an article engaging member 42' having an article engaging surface to engage an article 18 when the corresponding clamp assembly 28'/30' is in the first or article engagement position. Each second article engaging prong 34' comprises a prong member 46' including a retainer member or spring 40' formed or affixed to the upper end portion thereof and an article engaging member 48' having an article engaging surface to engage an article 18 when the corresponding clamp assembly 28'/30' is in the first or article engagement position. As best shown in FIG. 3, the first article engaging members 42' and 48' of the first clamp assembly 28' are disposed in spaced relation above the first article engaging members 42' and 48' of the second clamp assembly 30'.

As described more fully hereinafter, a first clip assembly positioning mechanism and a second clip assembly positioning mechanism each comprises a clip positioning mechanism and a prong positioning mechanism to selectively move the first article engaging prong 32' and the second article engaging prong 34' of the corresponding first clip assembly 28' and a second clip assembly 30' between the first or article engagement position to the second or article disengagement position.

As shown in FIGS. 5 through 6, each prong positioning mechanism comprises a spring or bias 52' disposed to engage the inner surface of the upper portions of the prong member 38' of the first article engaging prong 32' and the corresponding prong member 46' of the second article engaging prong 34' to normally maintain the corresponding clamp assembly 28' and 30' in the first or article engagement position. Each spring or bias 52' is retained in operative position by corresponding retainer members 40'.

As shown in FIGS. 5 and 6, each clip positioning mechanism comprises a first clip positioning actuator and a second clip positioning actuator to selectively move the corresponding first article engaging prong 32' and corresponding second article engaging prong 34' from the first or article engagement position to the second or article disengagement position to disengage the article 18 when the corresponding first and second article engagement prongs 32' and 34' are moved from the first or article engagement position to the second or article disengagement position.

The first clip positioning actuator comprises an actuator member generally indicated as 53' having a cam member or surface 54' having a first transition section or surface 56' and a second transition section or surface 57' disposed adjacent opposite ends thereof and a cam follower 58' rotatably attached a cam carriage 59' including an inclined cam surface 61' on each end portion thereof movable between a first or lower position and a second or upper position on the substantially vertical clamp assembly hanger or coupling member 36' by a pair of pins or members each indicated as 63' extending through a corresponding vertical slot or aperture 65'.

The actuator members 53' of the first clip assembly 28' and the second clip assembly 30' are disposed above the plating clamp assembly 10 in substantially parallel relationship relative to each other such that the corresponding cam members or surfaces 54' engages the corresponding cam follower 58' as the plating clamp assembly 10 moves or travels through the plating liquid/material 14 to selectively move the first and second article engaging prongs 32' and 34' from first or engagement position to second or disengagement position.

Each second clip positioning actuator generally indicated as 60' comprises a roller 62' rotatably mounted to the upper portion of the corresponding prong member 46' of second article engaging prong 34' by the pivot or pin 35' and the prong member 38' of first article engaging prong 32' to the pivot or pin 35'. The corresponding rollers 62' of the first or front article engaging prong 32' and second or rear article engaging prong 34' are disposed in spaced relationship relative to each other such that the cam carriage 59' is moved downward as the corresponding cam follower 58' engages the first transition section or surface 56' causing the inclined cam surfaces 61' to engage the rollers 62' forcing the corresponding first or front article engaging prong 32' and second article engaging prong 34' to pivot about the pivot or pin 35' moving the corresponding first clip assembly 28' and a second clip assembly 30' from the first or article engagement position to the second or article disengagement position to cause the prong member 38' of the first or front article engaging prong 32' from the first or article disengagement position to the second or article disengagement position such that the article engaging surface of first article engaging member 42' of first article engaging prong 32' disengages the article 18 at the same time the article engaging surface of article engaging member 48' of second article engaging prong 34' disengage the opposite side of the article 18.

The spring or bias 52' of each prong positioning mechanism will move corresponding plating clamp assembly 10 from second disengagement position to first or engagement position when the corresponding cam member or surface 54' and the corresponding cam follower or roller 58 are not engaged.

Figure 7:
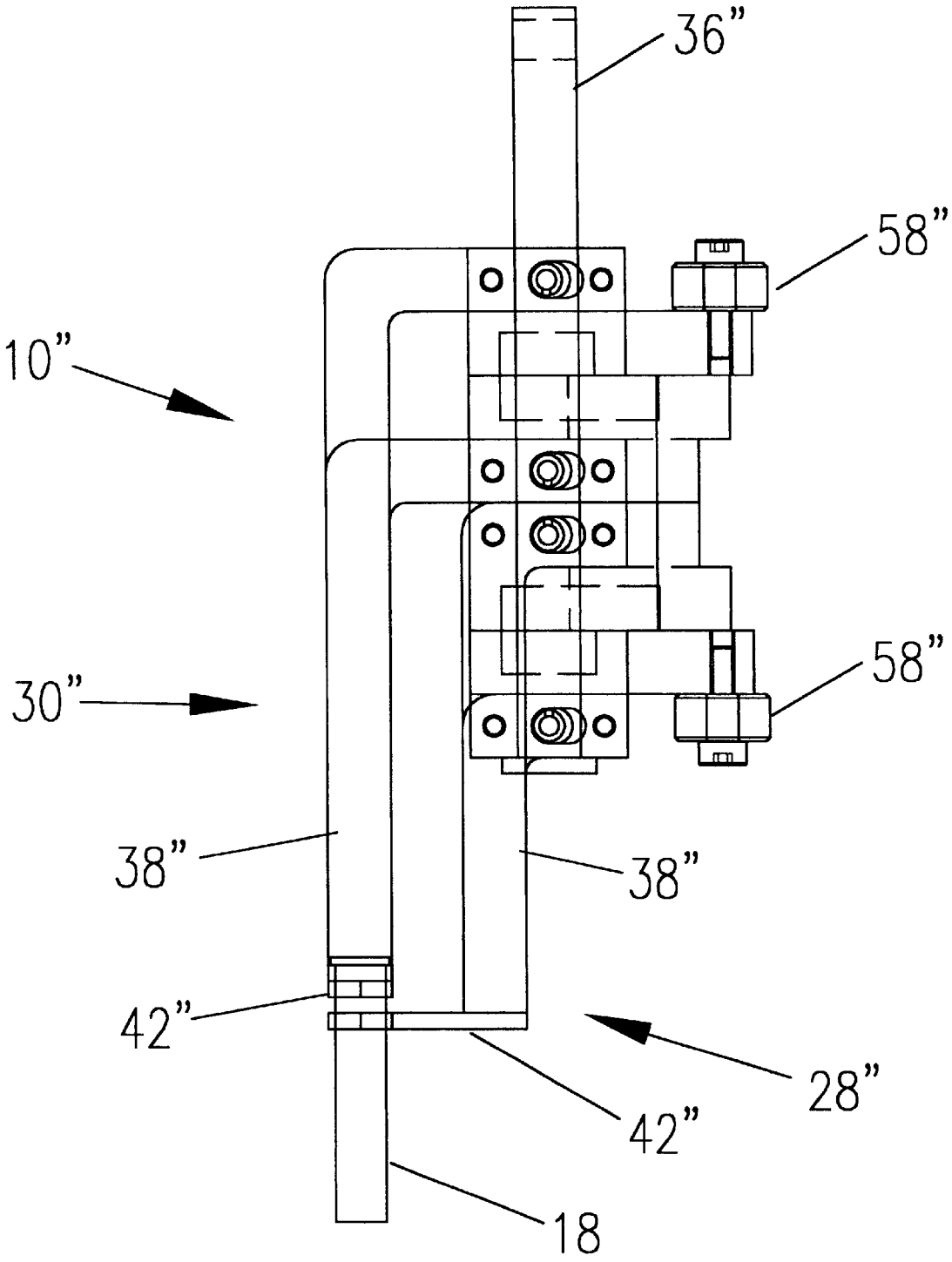
FIG. 7 is a detailed front view of another alternate embodiment of the plating clamp assembly of the present invention.
Figure 8:
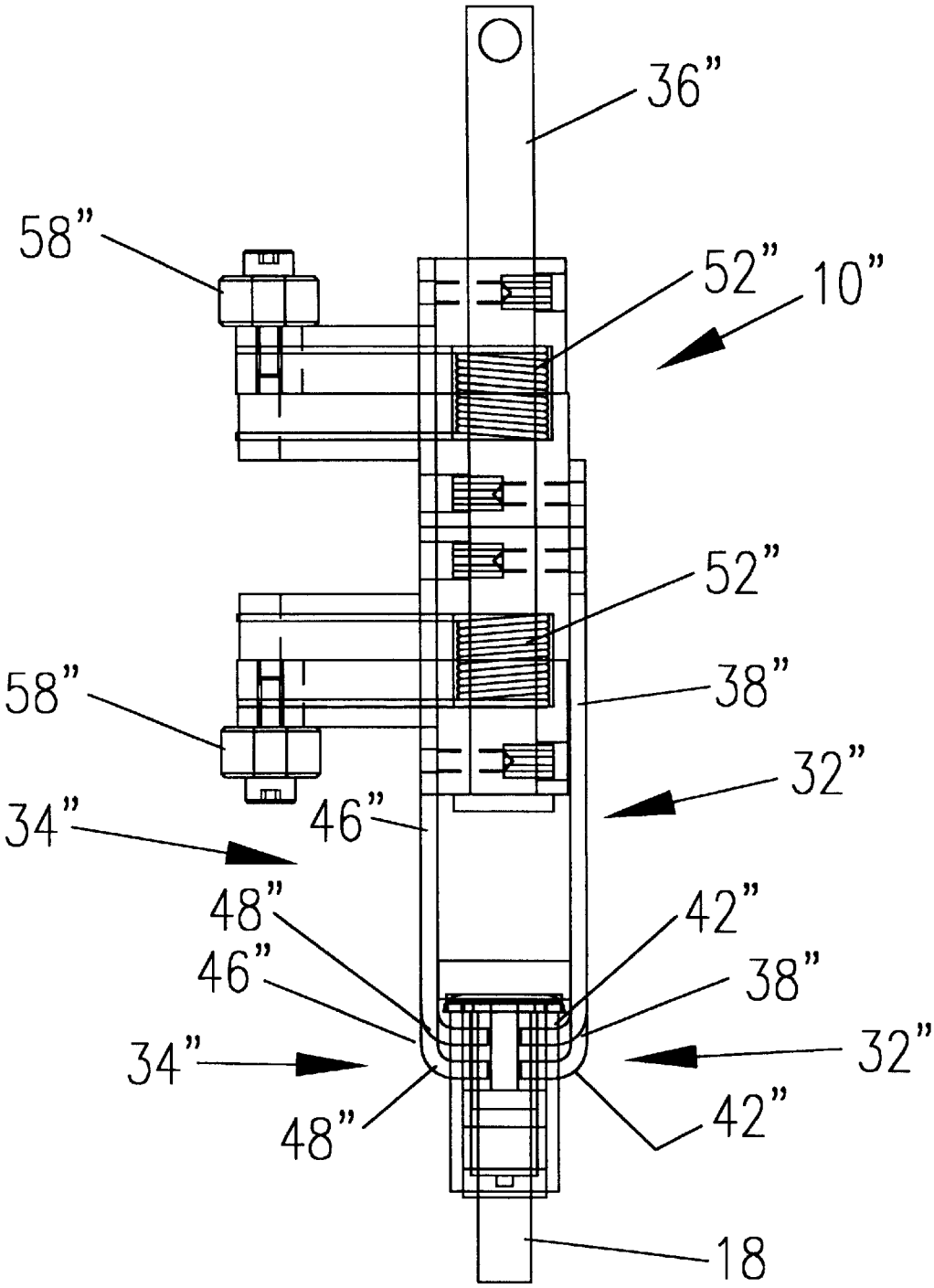
FIG. 8 is a detailed side view of the alternate embodiment of the plating clamp assembly of the present invention shown in FIG. 7.
Figure 9:
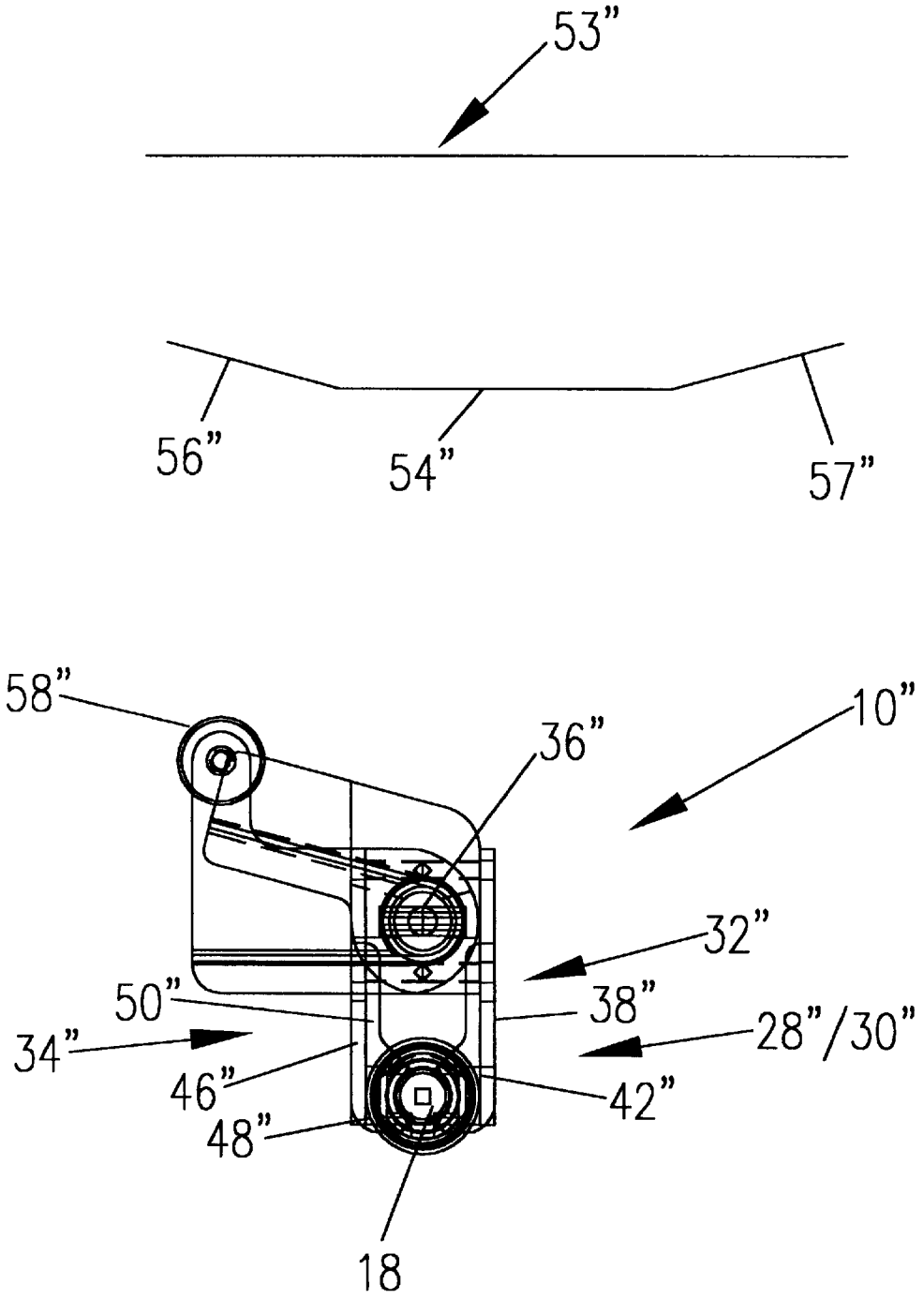
FIG. 9 is a partial top view of the alternate embodiment of the plating clamp assembly of the present invention shown in FIGS. 7 and 8.

FIGS. 7 through 9 show another alternate embodiment of the first clip assembly 28" and the second clip assembly 30". As shown in FIGS. 7 through 9, the first clip assembly 28" and the second clip assembly 30" each comprises a first or front article engaging prong generally indicated as 32" and a second or rear article engaging prong generally indicated as 34" pivotally mounted on a substantially vertical clamp assembly hanger or coupling member 36" coupled to the transport assembly 16.

As shown in FIGS. 7 through 9, each first article engaging prong 32" comprises a prong member 38" and an article engaging member 42" having an article engaging surface 44" to engage an article 18 when the corresponding clamp assembly 28"/30" is in the first or article engagement position. Each second article engaging prong 34" comprises a prong member 46" including an article engaging member 48" having an article engaging surface 50" to engage an article 18 when the corresponding clamp assembly 28"/30" is in the first or article engagement position. The first article engaging members 42" and 48" of the first clamp assembly 28" are disposed in spaced relation above the first article engaging members 42" and 48" of the second clamp assembly 30".

As described more fully hereinafter, the first clip assembly positioning mechanism and the second clip assembly positioning mechanism each comprises a clip positioning mechanism and a prong positioning mechanism to selectively move the first article engaging prong 32" and the second clip assembly 30" between the first or article engagement position to the second or article disengagement position.

As shown in FIGS. 7 through 9, each prong positioning mechanism comprises a hair pin shaped spring or bias 52" disposed to engage the inner surface of the upper portions of the prong member 38" of the first article engaging prong 32" and the corresponding prong member 46" of the second article engaging prong 34" to normally maintain the corresponding clamp assembly 28" and 30" in the first or article engagement position.

As shown in FIGS. 7 through 9, each clip positioning mechanism comprises a first clip positioning actuator to selectively move the corresponding first article engaging prong 32" from the first or article engagement position to the second or article disengagement position to disengage the article 18 and a second clip positioning actuator to selectively move the corresponding second article engaging prong 34" from the first or article engagement position to the second or article disengagement position to disengage the article 18 when the corresponding second article engagement prong moves from the first or article engagement position.

The first clip positioning actuator comprises an actuator member generally indicated as 53" having a plurality of cam members or surfaces each indicated as 54" having a first transition section or surface 56" and a second transition section or surface 57" disposed adjacent opposite ends thereof and a cam follower 58" rotatably attached to the upper end portion.

The actuator members 53" of the first clip assembly 28" and the second clip assembly 30" are disposed in the same corresponding horizontal plane beside the corresponding clamp assembly 28 and 30 in substantially parallel relationship relative to each other such that the corresponding cam members or surfaces 54" engages the corresponding cam follower 58" of the first clip positioning actuator 54" as the plating clamp assembly 10 moves or travels through the plating liquid/material 14 to selectively move the first article engaging prong 32" from first or engagement position to second or disengagement position.

The spring or bias 52" of each prong positioning mechanism will move corresponding plating clamp assembly 10 from second disengagement position to first or engagement position when the corresponding cam member or surface 54" and the corresponding cam follower 58" are not engaged. 15 The plurality of clamping configurations includes a fully engaged configuration, a first and second partially engaged configuration, and a fully disengaged configuration as depicted in FIG. 4. The load and unload condition depicted as A and G respectively are the fully disengaged configuration to permit articles 18 to be load into and unloaded from a plating clamp assembly 10 when the corresponding first clamp assembly 28 and the second clamp assembly 30 are each in the second or disengagment position where the corresponding first and second article engaging prongs 32 and 34 are held in the open position by the corresponding clip positioning mechanism such that the corresponding article engaging surface 44 of the first article engaging member 42 and the article engaging surface 50 of second article engaging member 48 are disposed in spaced relationship relative to the article 18 to be plated.

When the plating clamp assembly 10 is in the fully engaged configuration depicted as B, D and F, the corresponding first clip assembly 28 and the second clip assembly 30 are each in the first or engagement position where the corresponding first article engaging prongs 32 and 34 are held in closed position by the corresponding prong positioning mechanism such that the corresponding article engaging surface 44 of the first article engaging member 42 and the article engaging surface 50 of second article engaging member 48 engage to the article 18 to be plated to securely hold the article 18 to the plating clamp assembly 10 as the plating clamp assembly 10 and article 18 travel through the liquid container or reservoir 20.

When the plating clamp assembly 10 is in the first partially engaged configuration depicted as C, the corresponding first clamp assembly 28 is in the second or disengagement position where the corresponding first and second article engaging prongs 32 and 34 are held in the open position by the corresponding clip positioning mechanism such that the corresponding arcuate concave article engaging surface 44 of the first article engaging member 42 and the substantially flat article engaging surface 50 of second article engaging member 48 are disposed in spaced relationship relative to the article 18 to be plated and the corresponding second clamp assembly 30 is in the first or engagement position where the corresponding first article engaging prongs 32 and 34 are held in closed position by the corresponding prong positioning mechanism such that the corresponding article engaging surface 44 of the first article engaging member 42 and the article engaging surface 50 of second article engaging member 48 engage to the article 18 to be plated to securely hold the article 18 to the plating clamp assembly 10 as the plating clamp assembly 10 and article 18 travel through the liquid container or reservoir 20 to expose that portion of the article 18 previously beneath the article engaging surface 44 of the first article engaging member 42 and the article engaging surface 50 of second article engaging member 48 of the first clamp assembly 28 when in the first or engagement position.

When the plating clamp assembly 10 is in the second partially engaged configuration depicted as E, the corresponding second clamp assembly 30 is in the second or disengagement position where the corresponding first and second article engaging prongs 32 and 34 are held in the open position by the corresponding clip positioning mechanism such that the corresponding article engaging surface 44 of the first article engaging member 42 and the article engaging surface 50 of second article engaging member 48 are disposed in spaced relationship relative to the article 18 to be plated and the corresponding first clamp assembly 28 is in the first or engagement position where the corresponding first article engaging prongs 32 and 34 are held in closed position by the corresponding prong positioning mechanism such that the corresponding article engaging surface 44 of the first article engaging member 42 and the article engaging surface 50 of second article engaging member 48 engage to the article 18 to be plated to securely hold the article 18 to the plating clamp assembly 10 as the plating clamp assembly 10 and article 18 travel through the liquid container or reservoir 20 to expose that portion of the article 18 previously beneath the article engaging surface 44 of the first article engaging member 42 and the article engaging surface 50 of second article engaging member 48 of the second clamp assembly 30 when in the first or engagement position.

In operation, an article 18 to be plated is grasped by the first clip assembly and the second clip assembly as the plating clamp assembly 10 moves through the plating bath or processing chamber 12 with the clip assembly positioning mechanism and the second clip assembly positioning mechanism are each in the first or article engagement positions. As the plating clamp assembly 10 travels or moves through the processing chamber 12, the first clip assembly positioning mechanism and the second clip assembly positioning mechanism sequentially and independently move the corresponding clip positioning mechanism and prong positioning mechanism between the first and second positions to move the corresponding first and second article engaging prongs 38 and 46 between the first or article engagement position and the second or article disengagement position to coat portions of the surface of the article 18 with material without creating faults on the selected portion of the surface of the article 18.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A plating clamp assembly for use with a plating system including a plating bath and an article transport assembly to selectively engage an article to be plated as the article is moved through the plating bath by the article transport assembly to coat at least a selected portion of the surface of the article with material without creating faults on the selected portion of the surface of the article, said plating clamp assembly comprises a first clamp assembly and a second clamp assembly, said first clamp assembly comprises a first clip assembly moveable between an article engagement position and article disengagement position and a first clip assembly positioning mechanism to selectively position said first clamp assembly in the plurality of clamping configurations to load and unload an article into and from said plating clamp assembly and to selectively engage and disengage the article traveling through the plating bath during the plating process and said second clamp assembly comprises a second clip assembly selectively moveable between an article engagement position and an article disengagement position and a second clip assembly positioning mechanism to selectively position said second clamp assembly in the plurality of clamping configurations to load and unload an article into and from said plating clamp assembly and to selectively engage and disengage the article traveling through the plating bath during the plating process.

2. The plating clamp assembly of claim 1 wherein said first clip assembly and said second clip assembly each comprises a first article engaging prong and a second article engaging prong pivotally mounted to said plating clamp assembly.

3. The plating clamp assembly of claim 2 wherein said first article engaging prong comprises a prong member and an article engaging member to engage an article when in said article engagement position and said second article engaging prong comprises a prong member including an article engaging member to engage an article when in said article engagement position.

4. The plating clamp assembly of claim 3 wherein each said prong member is disposed in spaced relationship relative to the article when said corresponding article engaging member engages the article when in said article engagement position.

5. The plating clamp assembly of claim 3 wherein said article engaging members of said first clamp assembly are disposed in vertical spaced relation relative to said article engaging members of said second clamp assembly.

6. The plating clamp assembly of claim 5 wherein said article engaging member of said first article engaging prong includes an article engaging surface and said article engaging member of said second article engaging prong member includes an article engaging surface disposed to cooperatively grip the article therebetween when said corresponding clamp assembly is in the article engagement position.

7. The plating clamp assembly of claim 6 wherein said article engaging surface of each said first article engaging prong includes a recess to receive the article therein, said arcuate article engaging surfaces being offset in the horizontal plane relative to each other to cooperatively form an article alignment means to center the article within said plating clamp assembly.

8. The plating clamp assembly of claim 3 wherein each said first article engaging prong comprises a prong member.

9. The plating clamp assembly of claim 8 wherein each said prong member is disposed in spaced relationship relative to the article when said corresponding article engaging member engages the article when in said article engagement position.

10. The plating clamp assembly of claim 2 wherein said first clip assembly positioning mechanism and said second clip assembly positioning mechanism each comprises a clip positioning mechanism and a prong positioning mechanism to selectively move said first article engaging prong and said second article engaging prong of said corresponding first clip assembly and said second clip assembly between the article engagement position and the article disengagement position.

11. The plating clamp assembly of claim 10 wherein each said prong positioning mechanism comprises a bias disposed to engage said prong member of the first article engaging prong and said corresponding prong member of said second article engaging prong to normally maintain said plating clamp assembly in said article engagement position.

12. The plating clamp assembly of claim 11 wherein said bias is retained in operative position by a corresponding retainer member.

13. The plating clamp assembly of claim 10 wherein each clip positioning mechanism comprises a first clip positioning actuator to selectively move said corresponding first article engaging prong from the article engagement position to the article disengagement position to disengage the article and a second clip positioning actuator to selectively move said corresponding second article engaging prong from the article engagement position to the article disengagement position to disengage the article when said corresponding second article engagement prong moves from the article engagement position to the article disengagement position.

14. The plating clamp assembly of claim 13 wherein said first clip positioning actuator comprises an actuator member having at least one cam surface and a cam follower coupled to said corresponding prong member of said first article engaging prong disposed to selectively to engage said cam surface to move said corresponding prong member to move from the article engagement position to the article disengagement position.

15. The plating clamp assembly of claim 14 wherein said actuator members of said first clip assembly and said second clip assembly are disposed above said clamp assemblies in substantially parallel relationship relative to each other such that said corresponding cam surface engages said corresponding cam follower of said first clip positioning actuator as said plating clamp assembly moves through the plating liquid/material to selectively move said first article engaging prongs from engagement position to disengagement position.

16. The plating clamp assembly of claim 15 wherein said cam surfaces of said first clip positioning actuator of said first clip assembly and said second clip assembly are off-set longitudinally to alternately open and close said first clip assembly and said second clip assembly as the article passes through the plating cell.

17. The plating clamp assembly of claim 16 wherein said cam surfaces of said first clip positioning actuator of said first clip assembly and said second clip assembly are aligned while loading and unloading the article into and from said plating clamp assembly to simultaneously open and close said first clip assembly and said second clip assembly.

18. The plating clamp assembly of claim 14 wherein said cam surface including a first transition surface and a second transition surface disposed adjacent opposite ends thereof.

19. The plating clamp assembly of claim 18 wherein said actuator members of the first clip assembly and the second clip assembly are disposed above said clamp assemblies in substantially parallel relationship relative to each other such that the corresponding cam surfaces engages the corresponding cam follower of said first clip positioning actuator as the plating clamp assembly travels through the plating liquid/material to selectively move said first article engaging prong from the article engagement position to the article disengagement position.

20. The plating clamp assembly of claim 14 wherein said prong positioning mechanism moves said corresponding clamping assembly from second disengagement position to the article engagement position when said cam surface disengages said corresponding cam follower.

21. The plating clamp assembly of claim 13 wherein said second clip positioning actuator comprises a plurality of teeth formed on each said article engaging prong disposed to engage each other such that movement of said first article engaging prong from the article engagement position to the article disengagement position causes said second article engaging prong to move from the article disengagement position to the article disengagement position such that said article engaging member of first article engaging prong disengages the article at substantially the same time said article engaging member of second article engaging prong disengages the article.

22. The plating clamp assembly of claim 10 wherein said clip positioning mechanism comprises a first clip positioning actuator and a second clip positioning actuator to selectively move said corresponding first article engaging prong and corresponding second article engaging prong from the article engagement position to the article disengagement position to disengage the article when said first and second article engagement prongs are moved from the article engagement position to the article disengagement position.

23. The plating clamp assembly of claim 22 wherein said first clip positioning actuator comprises an actuator member having at least one cam surface and a cam follower rotatably attached to a cam carriage and each said second clip positioning actuator comprises a cam mounted to the upper portion of said corresponding prong member of second article engaging prong and said corresponding prong member of said first article engaging prong; said corresponding cams of said first article engaging prong and said corresponding second article engaging prong are disposed in spaced relationship relative to each other such that said cam carriage is moved downward as said corresponding cam follower engages said cam surface whereby said cams engage said cam carriage moving said corresponding first clip assembly and said corresponding second clip assembly from the article engagement position to the article disengagement position to cause said prong member of said first article engaging member of said first article engaging prong to disengage the article at the same time the article engaging surface of said article engaging member of said article engaging prong to disengage the article.

24. The plating clamp assembly of claim 23 wherein each said cam carriage includes an inclined cam surface on each end portion thereof to selectively engage said cams, said prong member of said first article engaging prong and said second article engaging prong at substantially the same time.

25. The plating clamp assembly of claim 24 wherein said actuator members of said first clip assembly and said second clip assembly are disposed above said clamp assemblies in substantially parallel relationship relative to each other such that said corresponding cam surface engages said corresponding cam follower of said first clip positioning actuator as said plating clamp assembly moves through the plating liquid/material to selectively move said first article engaging prongs from engagement position to disengagement position.

26. The plating clamp assembly of claim 25 wherein said cam surface including a first transition surface and a second transition surface disposed adjacent opposite ends thereof.

27. The plating clamp assembly of claim 26 wherein said actuator members of the first clip assembly and the second clip assembly are disposed above said clamp assemblies in substantially parallel relationship relative to each other such that the corresponding cam surfaces engages the corresponding cam follower of said first clip positioning actuator as the plating clamp assembly travels through the plating liquid/material to selectively move said first article engaging prong from the article engagement position to the article disengagement position.

28. A plating clamp assembly for use with an electroplating system including a plurality of process cells and an article transport assembly to selectively engage an article to be electroplated as the article is moved through the various processes, ensuring that all the areas of the article are completely and uniformly processed leaving no unplated areas, marks, dents, water spots or other imperfections at the contact points between the article and said plating clamp or elsewhere on the article; said plating clamp assembly comprises said plating clamp assembly comprises a first clamp assembly and a second clamp assembly, said first clamp assembly comprises a first clip assembly moveable between an article engagement position and article disengagement position and a first clip assembly positioning mechanism to selectively position said first clamp assembly in the plurality of clamping configurations to load and unload an article into and from said plating clamp assembly and to selectively engage and disengage the article traveling through the plating bath during the plating process and said second clamp assembly comprises a second clip assembly selectively moveable between an article engagement position and an article disengagement position and a second clip assembly positioning mechanism to selectively position said second clamp assembly in the plurality of clamping configurations to load and unload an article into and from said plating clamp assembly and to selectively engage and disengage the article traveling through the plating bath during the plating process.

29. The plating clamp assembly of claim 28 wherein said first clip assembly and said second clip assembly each comprises a first article engaging prong and a second article engaging prong pivotally mounted to said plating clamp assembly.

30. The plating clamp assembly of claim 29 wherein said first article engaging prong comprises a prong member and an article engaging member to engage an article when in said article engagement position and said second article engaging prong comprises a prong member including an article engaging member to engage an article when in said article engagement position.

31. The plating clamp assembly of claim 30 wherein each said prong member is disposed in spaced relationship relative to the article when said corresponding article engaging member engages the article when in said article engagement position.

32. The plating clamp assembly of claim 30 wherein said article engaging members of said first clamp assembly are disposed in vertical spaced relation relative to said article engaging members of said second clamp assembly.

33. The plating clamp assembly of claim 32 wherein said article engaging member of said first article engaging prong includes an article engaging surface and said article engaging member of said second article engaging prong member includes an article engaging surface disposed to cooperatively grip the article therebetween when said corresponding clamp assembly is in the article engagement position.

34. The plating clamp assembly of claim 33 wherein said article engaging surface of each said first article engaging prong includes a recess to receive the article therein, said arcuate article engaging surfaces being offset in the horizontal plane relative to each other to cooperatively form an article alignment means to center the article within said plating clamp assembly.

35. The plating clamp assembly of claim 30 wherein said first clip assembly and said second clamp assembly are alternately open and close the article passes through the plating cell.

36. The plating clamp assembly of claim 35 wherein said first clamp assembly and said second clamp assembly simultaneously open and close when loading and unloading the article into and from said plating clamp assembly.

* * * * *